US006886219B2

(12) United States Patent
Oepping et al.

(10) Patent No.: US 6,886,219 B2
(45) Date of Patent: May 3, 2005

(54) ADJUSTABLE HINGE

(75) Inventors: Wilfried Oepping, Kirchlengern (DE); Udo Stellbrink, Kirchlengern (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 0 days.

(21) Appl. No.: 10/465,865

(22) Filed: Jun. 20, 2003

(65) Prior Publication Data

US 2004/0068842 A1 Apr. 15, 2004

(30) Foreign Application Priority Data

Jun. 21, 2002 (DE) ..... 202 09 688 U

(51) Int. Cl.[7] ..... E05D 7/04
(52) U.S. Cl. ..... 16/235; 16/225; 16/226
(58) Field of Search ..... 16/235, 225, 226, 16/257, 258

(56) References Cited

U.S. PATENT DOCUMENTS 4,641,394 A 2/1987 Rock et al.
4,768,259 A * 9/1988 Rock et al. ..... 16/382
4,862,556 A * 9/1989 Grass ..... 16/382
5,611,113 A * 3/1997 Rock et al. ..... 16/246
5,621,947 A * 4/1997 Fitz et al. ..... 16/249
6,061,872 A * 5/2000 Albrecht et al. ..... 16/258
6,088,879 A * 7/2000 Gasser ..... 16/257
6,203,231 B1 * 3/2001 Salice ..... 403/12
6,336,253 B1 * 1/2002 Salice ..... 16/382
6,532,626 B2 * 3/2003 Muller et al. ..... 16/245

FOREIGN PATENT DOCUMENTS

DE 35 13 521 A1 11/1985
DE 200 20 998.1 5/2002

* cited by examiner

*Primary Examiner*—Suzanne Dino Barrett
*Assistant Examiner*—Mark Williams
(74) *Attorney, Agent, or Firm*—Barnes & Thornburg

(57) ABSTRACT

The present invention is a hinge for furniture that includes a first hinge part rotatably connected with a second hinge part via at least one hinge axis. The first hinge part has a substantially U-shaped cross-section with its legs on one end having free ends that point toward a piece of the furniture. The free ends have fastening flanges bent laterally in a plane substantially parallel to the piece of furniture. A first area of the legs being expandable at free ends of the legs creating a trapezoidal cross-section when the flanges are mounted to the piece of furniture, and the legs have a resulting cambered construction. A second area of the legs being substantially parallel, and the at least one hinge axis being located in this second area.

6 Claims, 1 Drawing Sheet

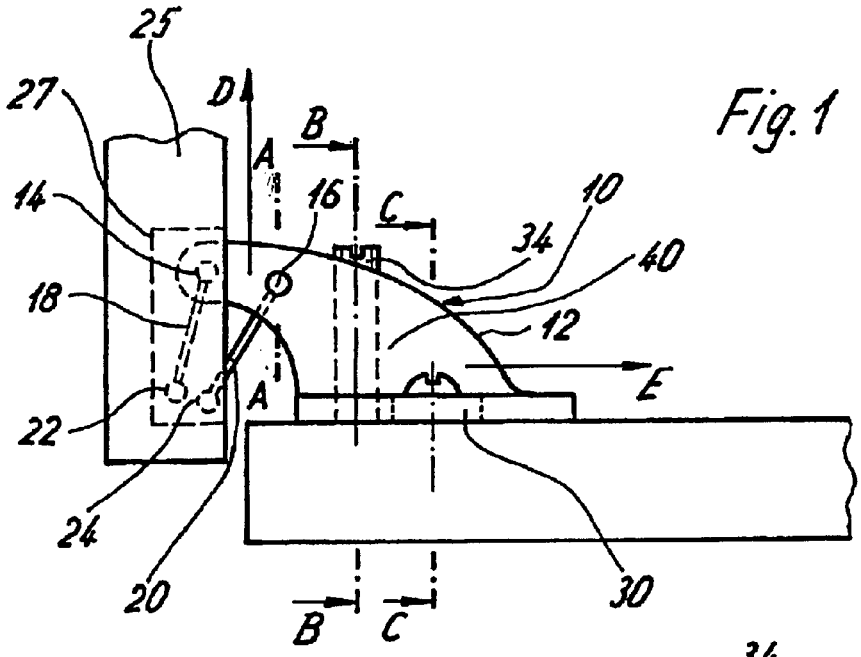
Fig. 1
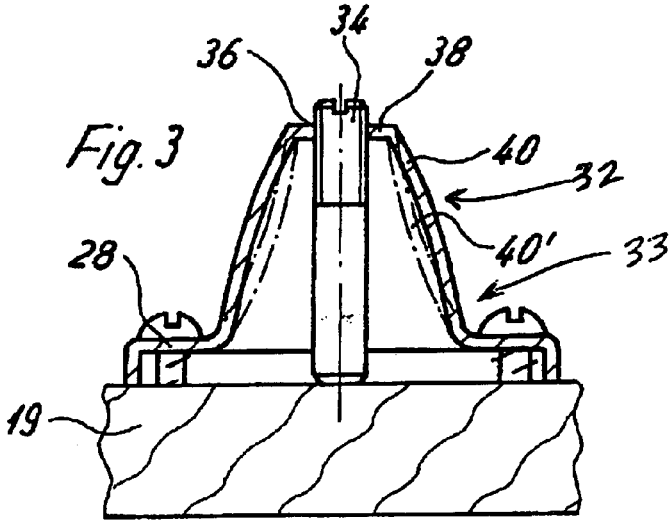
Fig. 3
Fig. 2
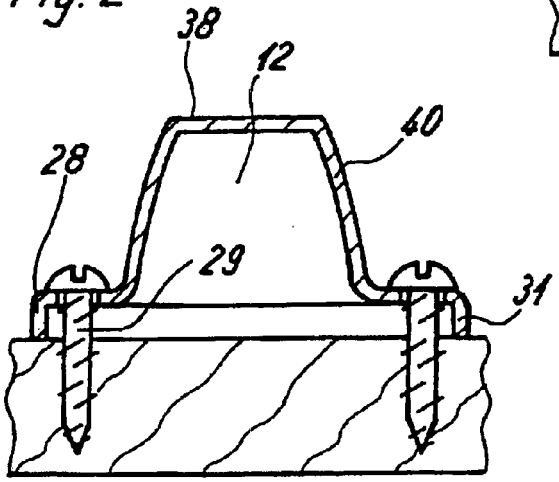
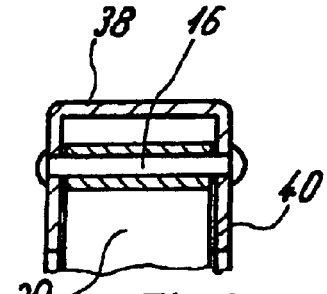
Fig.4

ADJUSTABLE HINGE

CROSS-REFERENCE

This non-provisional application claims benefit to German Application Number 202 09 688.2, filed Jun. 21, 2002, which disclosure is hereby incorporated by reference herein.

BACKGROUND AND SUMMARY OF THE INVENTION

The present invention relates to a hinge for furniture.

It is known that hinges have been used which consist of a mounting plate connected with the wall of the piece of furniture and of a hinge arm fastened thereon. The hinge arm is adjustably connected with the mounting plate. A hinge of this type is known, for example, as a result of German Patent Document DE 35 13 521 A1.

It is also known to produce mounting plates in one piece with the hinge arm and to bend the mounting plate under the hinges, the mounting plate being connected with the hinge arm by way of an adjusting screw. See German Patent Document DE 200 20 998 U1.

An aspect of the present invention is a hinge of the above-mentioned type, which is vertically adjustable with respect to a wall of the piece of furniture.

The present invention is a hinge for furniture that includes a first hinge part rotatably connected with a second hinge part via at least one hinge axis. The first hinge part has a substantially U-shaped cross-section with its legs on one end having free ends that point toward a piece of the furniture. The free ends have fastening flanges bent laterally in a plane substantially parallel to the piece of furniture. A first area of the legs being expandable at free ends of the legs creating a trapezoidal cross-section when the flanges are mounted to the piece of furniture, and the legs have a resulting cambered construction. A second area of the legs being substantially parallel, and the at least one hinge axis being located in this second area.

In accordance with the present invention, the hinge can be vertically adjusted in a simple manner and, because of the outer shape of the hinge, it has a closed appearance. The vertical adjustment may take place, for example, by an adjusting screw.

According to a preferred embodiment, the trapezoidal area of the hinge arm may have a particularly elastic construction and may be cambered outwardly.

According to another embodiment, the trapezoidal area may be cambered inwardly. And, another embodiment may provide that the fastening flanges have surrounding reinforcing edges, so that a secure fastening to the wall of the piece of furniture can be achieved.

In another embodiment of the present invention, an area of the hinge arm, whose lateral walls are cambered but substantially parallel, may have a springy construction.

The invention will be better understood and appreciated from the following detailed descriptions and with reference to the accompanying drawings.

BRIEF DESCRIPTION OF THE DRAWINGS

FIG. 1 is a lateral view of a hinge, according to the principles of the present invention.

FIG. 2 is a sectional view along Line C—C in FIG. 1.

FIG. 3 is a sectional view along Line B—B in FIG. 1.

FIG. 4 is a sectional view along Line A—A in FIG. 1.

DETAILED DESCRIPTION OF THE PREFERRED EMBODIMENTS

As shown in the embodiment of FIG. 1, hinge 10 includes a hinge arm 12 and two hinge axes or pins 14, 16 connected to or disposed thereon. Also included are two articulated levers 18, 20 disposed or connected in a rotatable manner to hinge arm 12 via pins 14, 16 respectively. The levers 18, 20 are rotatably connected at their other ends by axes or hinge pins 22, 24 with a hinge housing 27, which is embedded, for example, in a door 25 of a piece of the furniture. In order to be able to adjust hinge arm 12 in direction E, the hinge arm 12 includes flanges 28 which have oblong holes 30 for fastening screws 29. The flanges 28 also have bent-off reinforcing edges 31.

An adjustment of the hinge pins 14, 16 in a vertical or direction D, may be made using adjusting screw 34 which is disposed in a thread 36 of the hinge arm 12. When the adjusting screw 34 is rotated such that it is pressed against a wall 19, for example, of a piece of the furniture, a yoke 38 of the hinge arm 12 is pressed away from the wall 19 of the piece of furniture. The hinge arm 12 has cambered side walls 40 that yield elastically and thus permit an adjustment of the hinge pins 16, 14 and of the door 25 in the D direction. The cambered side walls 40 and the yoke 38 form or have a U-shaped cross-section with spread-open legs 32, which, when connected to the wall 19 essentially forms a trapezoid cross-section at or adjacent free ends of 33 a first area of the legs. The trapezoid may also include more extensively curved legs of the U than shown in the Figures.

The embodiment shown FIG. 1 is a so-called multi-joint hinge. A bearing for the articulated levers 18, 20 is necessary, which corresponds to existing load requirements, because these articulated levers 18, 20 have to carry a dead load that extends in a direction that is perpendicular to the flat plane of the sheet of paper of the Figures. FIG. 4 shows a second area of hinge arm 12 where sections 40" of the hinge arm 12 extend substantially parallel to one another. The transition of this substantially parallel wall area 40" into a curved or cambered area 40, as in FIGS. 2 and 3, is progressively continuous. FIG. 2 also demonstrates that the cambering of walls 40 may be curved inward, as in curved wall 40" or curved more outward than wall 40 (not shown). Hinge arm 12 is constructed in a springy manner in the previously mentioned upper area, at or adjacent walls 40", such that, as a result of a force of the adjusting screw 34, the door 25 follows the springy movements of the hinge arm 12 in direction D and in an opposite direction of D. An adjustment of the hinge 12 arm in direction E and in the opposite direction of E is permitted because the fastening screws 29 can move along a length of oblong holes 30.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A hinge for furniture, comprising a first hinge part rotatably connected with a second hinge part via at least one hinge pin, the first hinge part having a substantially U-shaped cross-section with legs of the U-shaped cross-section on one end having free ends that point toward a piece of the furniture, and the free ends have fastening flanges bent laterally in a plane substantially parallel to the piece of furniture;

a first area of the legs located between the fastening flanges and a second area of the legs being spreadable to allow for vertical adjustment and creating a trapezoidal cross-section when the flanges are mounted to the piece of furniture, and the legs have a resulting cambered construction; and the second area of each of the legs being substantially parallel to one another, and the at least one hinge pin being located in this second area.

2. The hinge according to claim 1, wherein the cambered legs of the hinge arm are curved outward.

3. The hinge according to claim 1, wherein the cambered legs of the hinge arm are curved inward.

4. The hinge according to claim 1, wherein the fastening flanges have reinforcing edges.

5. The hinge according to claim 1, wherein the hinge arm has a springy construction in the trapezoidal cross-section area.

6. The hinge according to claim 1, wherein an adjusting screw is provided by which a yoke between the legs of the U-shaped cross-section is vertically adjustable.

* * * * *